US011118734B2

(12) United States Patent
Carlander-Reuterfelt

(10) Patent No.: US 11,118,734 B2
(45) Date of Patent: Sep. 14, 2021

(54) COLD-BOX SYSTEM AND APPARATUS FOR POWER MANAGEMENT ABOARD SHIPS

(71) Applicant: MAN Energy Solutions SE, Augsburg (DE)

(72) Inventor: Christer Carlander-Reuterfelt, Gothenburg (SE)

(73) Assignee: MAN Energy Solutions SE, Augsburg (DE)

( * ) Notice: Subject to any disclaimer, the term of this patent is extended or adjusted under 35 U.S.C. 154(b) by 58 days.

(21) Appl. No.: 16/170,375

(22) Filed: Oct. 25, 2018

(65) Prior Publication Data

US 2019/0072234 A1 Mar. 7, 2019

Related U.S. Application Data

(62) Division of application No. 14/540,419, filed on Nov. 13, 2014, now Pat. No. 10,145,514.

(Continued)

(51) Int. Cl.

| | |
|---|---|
| ***F17C 3/02*** | (2006.01) |
| ***F17C 13/08*** | (2006.01) |
| ***B63B 25/16*** | (2006.01) |

(52) U.S. Cl.

CPC ..... *F17C 3/025* (2013.01); *B63B 25/16* (2013.01); *F17C 13/082* (2013.01); *F17C 2201/0104* (2013.01); *F17C 2201/0119* (2013.01); *F17C 2201/032* (2013.01); *F17C 2201/052* (2013.01); *F17C 2203/03* (2013.01); *F17C 2205/0111* (2013.01); *F17C 2205/0126* (2013.01);

(Continued)

(58) Field of Classification Search

None

See application file for complete search history.

(56) References Cited

U.S. PATENT DOCUMENTS

| | | | |
|---|---|---|---|
| 3,100,385 | A | 8/1963 | Becker |
| 4,675,037 | A | 6/1987 | Newton |

(Continued)

FOREIGN PATENT DOCUMENTS

| | | |
|---|---|---|
| EP | 2503269 | 9/2012 |
| EP | 2553370 | 6/2013 |

(Continued)

OTHER PUBLICATIONS

Economic Commission for Europe "Proposed Text of a Derogation Regarding the Use of LNG for Propulsion for a Push Boat to Be Built by Kooiman Marine", Joint Meeting of Experts on the Regulations Annexed to the European Agreement Concerning the International Carriage of Dangerous Goods by Inland Waterways (AND) (ADN Safety Committee), Jan. 27-31, 2014, Geneva.

(Continued)

*Primary Examiner* — Shawn M Braden

(74) *Attorney, Agent, or Firm* — Cozen O'Connor

(57) ABSTRACT

A cold-box system includes a bulk gas tank, and a plurality of cold-box compartments operationally associated with the bulk gas tank. A cold-box apparatus includes a plurality of cold-box compartments operationally associated with a bulk gas tank. In one embodiment the cold-box compartments may be spaced apart from the tank aboard a waterborne platform. The system and apparatus provide redundancy regarding power aboard ship for the bulk gas tank.

13 Claims, 5 Drawing Sheets

Related U.S. Application Data

(60) Provisional application No. 61/905,314, filed on Nov. 18, 2013.

(52) U.S. Cl.
CPC ..... *F17C 2205/0176* (2013.01); *F17C 2205/0184* (2013.01); *F17C 2205/0188* (2013.01); *F17C 2205/0352* (2013.01); *F17C 2221/033* (2013.01); *F17C 2223/0161* (2013.01); *F17C 2223/033* (2013.01); *F17C 2260/042* (2013.01); *F17C 2270/011* (2013.01); *F17C 2270/0105* (2013.01); *F17C 2270/0121* (2013.01)

(56) References Cited

U.S. PATENT DOCUMENTS

| | | | | |
|---|---|---|---|---|
| 5,896,755 | A | 4/1999 | Wong | |
| 6,101,840 | A | 8/2000 | Watanabe | |
| 6,182,470 | B1 * | 2/2001 | Guillard | F25J 3/04303 62/646 |
| 6,378,331 | B1 | 4/2002 | Vancauwenberghe | |
| 7,340,921 | B2 | 3/2008 | Coyte | |
| 7,690,365 | B2 | 4/2010 | Lee | |
| 8,104,341 | B2 | 1/2012 | Lagergren | |
| 9,051,749 | B2 | 6/2015 | Peltier | |
| 2001/0018829 | A1 | 9/2001 | Wagner | |
| 2004/0250871 | A1 * | 12/2004 | Bingham | F17C 7/02 141/59 |
| 2006/0086141 | A1 | 4/2006 | Cote | |
| 2006/0260357 | A1 | 11/2006 | Gibbon | |
| 2009/0211295 | A1 | 8/2009 | Cavagne | |
| 2011/0100055 | A1 * | 5/2011 | Brigham | F25J 3/04636 62/643 |
| 2011/0146341 | A1 | 6/2011 | Raymond | |
| 2012/0012225 | A1 * | 1/2012 | Moszkowski | F17C 5/06 141/4 |
| 2015/0129082 | A1 * | 5/2015 | Murphy | F17C 5/06 141/4 |

FOREIGN PATENT DOCUMENTS

| | | |
|---|---|---|
| EP | 2775194 | 9/2014 |
| JP | S62-192493 | 8/1987 |
| JP | 2001-279280 | 10/2001 |
| JP | 2005-140163 | 6/2005 |
| JP | 2007-155060 | 6/2007 |
| JP | 2009-501896 | 1/2009 |
| JP | 2010-249318 | 11/2010 |
| JP | 2011-520081 | 7/2011 |
| JP | 2011-157979 | 8/2011 |
| JP | 2013-087911 | 5/2013 |
| WO | WO 2007/011155 | 1/2007 |

OTHER PUBLICATIONS

Man Energy Solutions "Marine Engine Programme".
Chart Innovation Experience Performance "Installation, Operation, and Maintenance Manual for Chart Cold Box Assemblies", pp. 1-30.
Managing Risk DNV Gas Engine Propulsion in Ships Safety Considerations, Torill Grimstad Osberg DNV, Washington, Jun. 2008, pp. 1-31.
Björn Munko, TGE Marine Gas Engineering Supply, Storage and Handling of LNG as Ship's Fuel, LNG 17, Houston, pp. 1-23.
Henning Mohn, MSc, Managing Risk DNV, "LNG as Ship Fuel. Operational Experience and Safety Barriers" German Presidency of the Council of the Baltic Sea, DNV Advisory, Norway, Berlin, Apr. 23, 2012.
The European Union's TEN-T Programme, LNG Masterplan for Rhine-Main-Danube, pp. 1-140, Apr. 2015.

* cited by examiner

COLD-BOX SYSTEM AND APPARATUS FOR POWER MANAGEMENT ABOARD SHIPS

This application is a divisional application of U.S. Ser. No. 14/540,419, filed Nov. 13, 2014 (allowed) and provisional application Ser. No. 61/905,314, filed Nov. 18, 2013.

BACKGROUND

The present embodiments relate to cold boxes for liquid natural gas (LNG) tanks aboard ship.

A cold-box is operationally associated with or connected to an LNG tank for gas handling. Aboard ship, requirements regarding the containment, monitoring and control of LNG are heavily regulated and cannot be neglected or waived.

There is no law or regulation requiring LNG tanks aboard ship. What is required however is a control system for the LNG tank if such a tank is aboard the ship. Therefore, it is usual to have a control system coacting with an LNG tank, and in that regard, to have two separate LNG tanks each with its own control system. This provides the necessary redundancy and back-up systems required by shipping regulations for such LNG tank(s). However, failure or malfunction of the control system will adversely impact operation of the related LNG tank and perhaps operation of the ship as well.

BRIEF DESCRIPTION OF THE DRAWINGS

For a more complete understanding of the present embodiments, reference may be had to the following description taken in conjunction with the drawing Figures, of which.

SUMMARY OF THE INVENTION

There is therefore provided a cold-box system which includes a bulk gas tank, and a plurality of cold-box compartments operationally associated with the bulk gas tank.

There is also provided a cold-box apparatus having a plurality of cold-box compartments for use with a bulk gas tank.

The gas in the bulk gas tank may be liquefied natural gas, and the system, apparatus and tank may be disposed ashore or aboard a waterborne or an ocean going platform, such as for example an LNG ship.

DETAILED DESCRIPTION OF THE INVENTION

Before explaining the present embodiments in detail, it is intended that the inventive embodiments are not limited in their application to the details of construction and arrangement of parts illustrated in the accompanying Figures. Also, the phraseology or terminology employed herein is for the purpose of description and not of limitation.

The present embodiments provide redundancy regarding power aboard ship, particularly aboard LNG ocean going vessels or other bulk gas product carriers. That is, the present embodiments eliminate the need for two separate LNG tanks aboard ship as is normally required for system redundancy purposes. Instead, the present embodiments call for using a plurality of cold-boxes, for example two cold-boxes for control systems), for each LNG tank; and each cold-box has the necessary equipment for power supply. Such embodiments provide the necessary and regulatory redundancy (back-up) of the power systems required for each LNG tank aboard ship. In certain applications and under shipping classification rules, a cold-box is referred to as a "tank connection space".

The present embodiments eliminate the need for two separate LNG tanks aboard a ship, as the requirement for redundancy of control systems is achieved with one LNG tank having two cold-boxes, each one of the cold-boxes having the necessary equipment to supply power to the tank.

All dimensions and weights referred to in the Figures are by way of example only.

Figure 1:
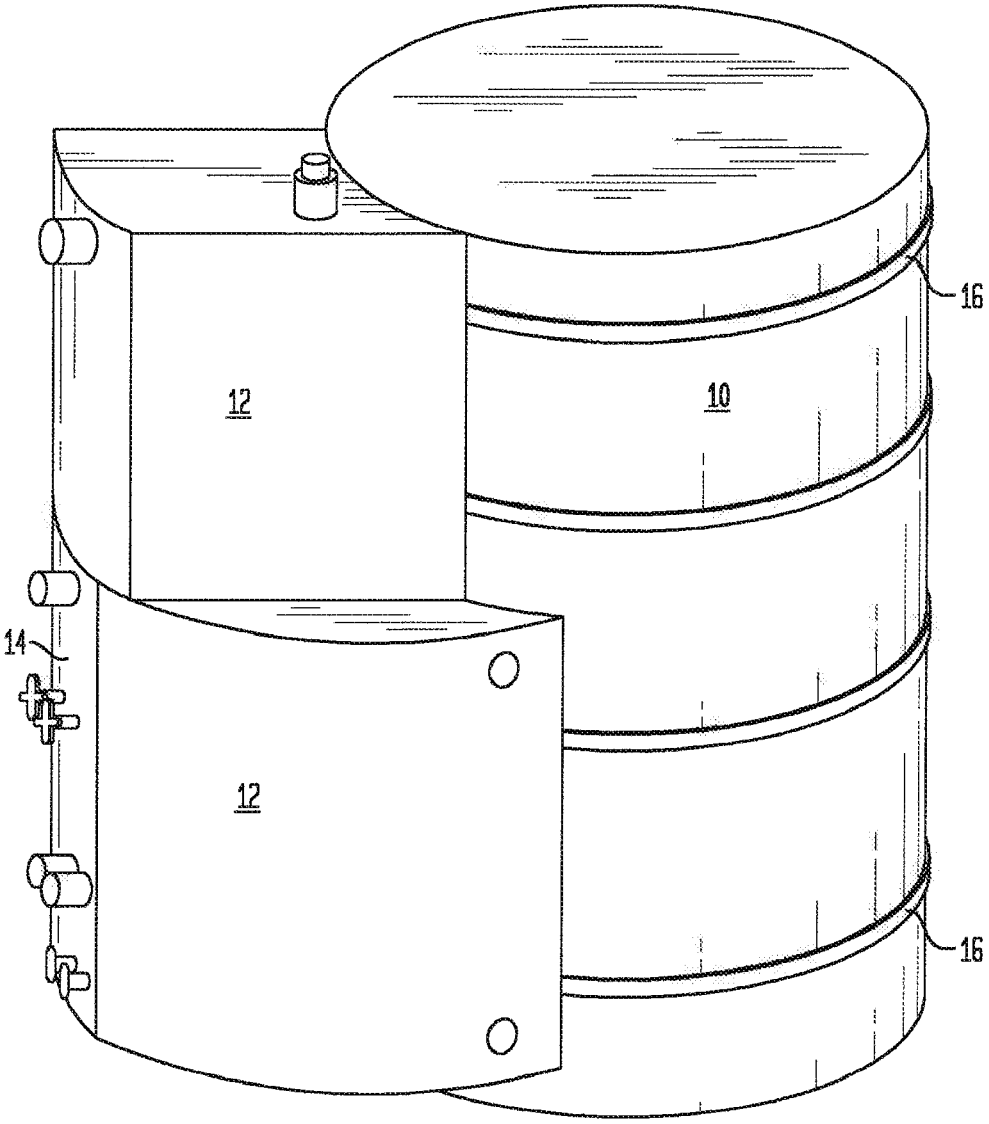
FIG. 1 shows an embodiment of a cold-box apparatus for use with an LNG tank aboard ships.
Figure 2C:
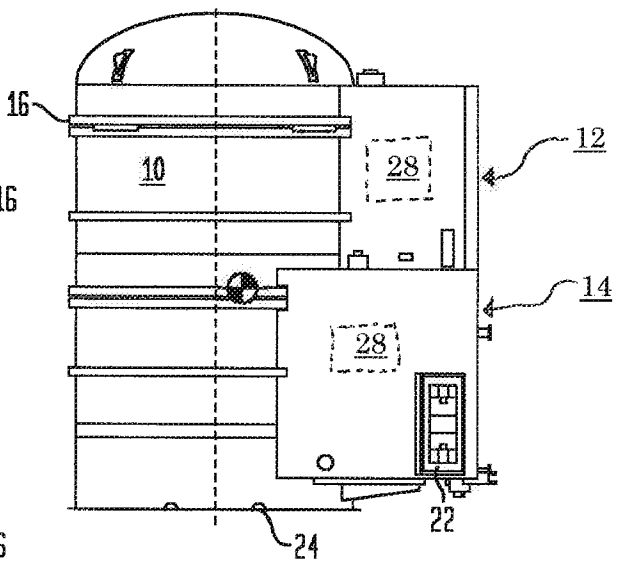
FIGS. 2A-2E shows different views of the embodiment of FIG. 1.
Figure 2B:
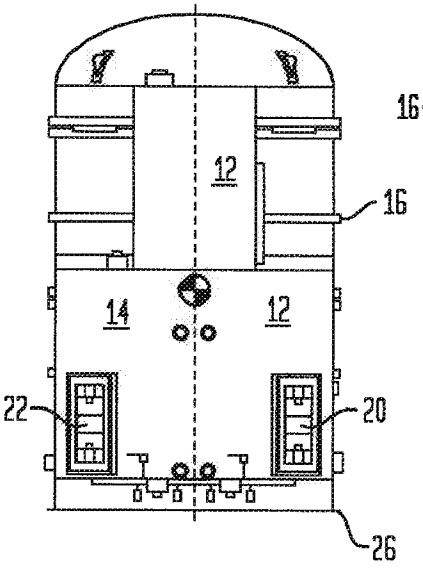

Referring to FIGS. 1 and 2A-2E, a bulk gas tank, such as for example an LNG tank 10 for shipboard use has two cold-box compartments, or cold-boxes 12, 14 operationally associated therewith. As shown in said Figures, cold box 12 is the starboard (SB) side cold box operationally associated with the tank 10, and cold-box 14 is the port side (PS) cold box also operationally associated with the tank and mounted next to the cold box 12. The cold boxes 12, 14 may be arranged adjacent to the tank 10. The control and power supply equipment is schematically shown in FIG. 2C at 28. At least one or alternatively a plurality of reinforcement rings 16 are shown in FIGS. 1 and 2A-2D circumscribing a an exterior surface of the tank 10. The rings 16 provide structure and strength to the tank 10.

Lifting lugs 18 are provided at an exterior of the tank 10 for loading and unloading the tank and the cold boxes 12, 14 to a desired location aboard ship or ashore. The lifting lugs 18 may be mounted or affixed to a top or upper region of the tank 10 as shown for example in FIG. 2A.

Figure 2A:
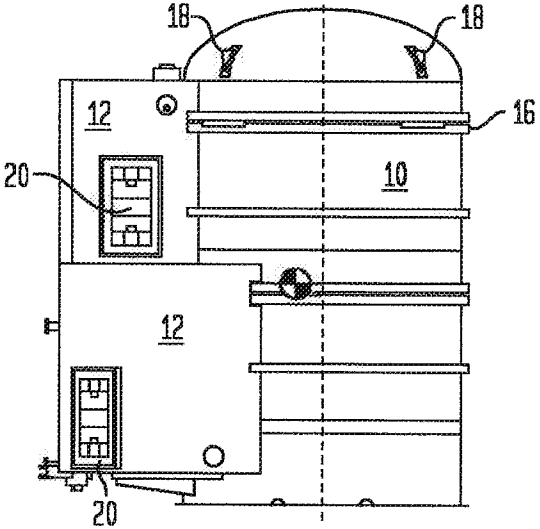
Figure 2D:
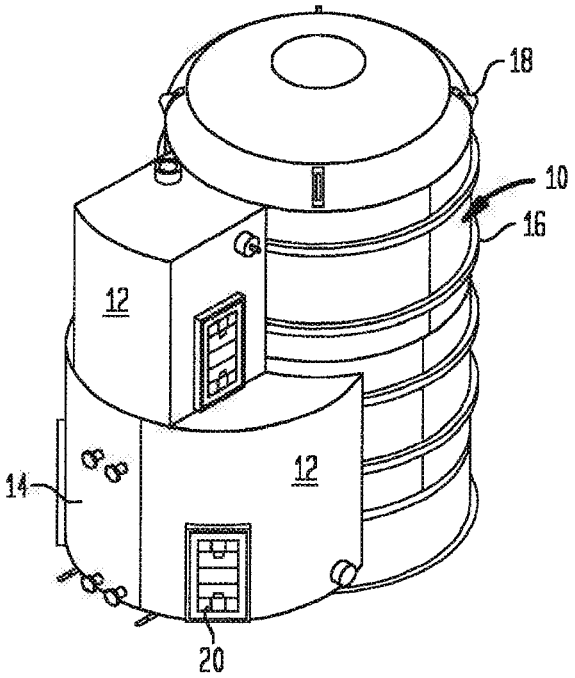
Figure 2E:
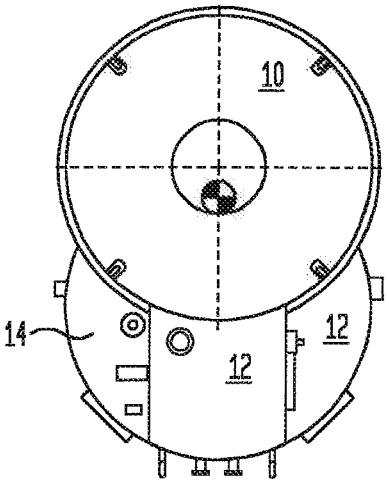

Each of the cold boxes 12, 14 is provided with a corresponding entrance hatch 20, 22, respectively, to permit entry into the respective one of the cold-boxes 12, 14. The cold box 12 is provided, by way of example only, with a plurality of the hatches 20, as shown in FIG. 2A, Each of the cold boxes 12, 14 can be insulated at all sides with, for example, A60 insulation. The construction of the cold-boxes can be with stainless steel.

Lashing lugs 24 are provided for lashing or securing the tank 10 to ship decks or trailers for transportation. In most instances, however, the lugs 24 will be removed (by cutting for example) after the tank 10 is securely mounted to a deck 26 of a ship.

Figure 3:
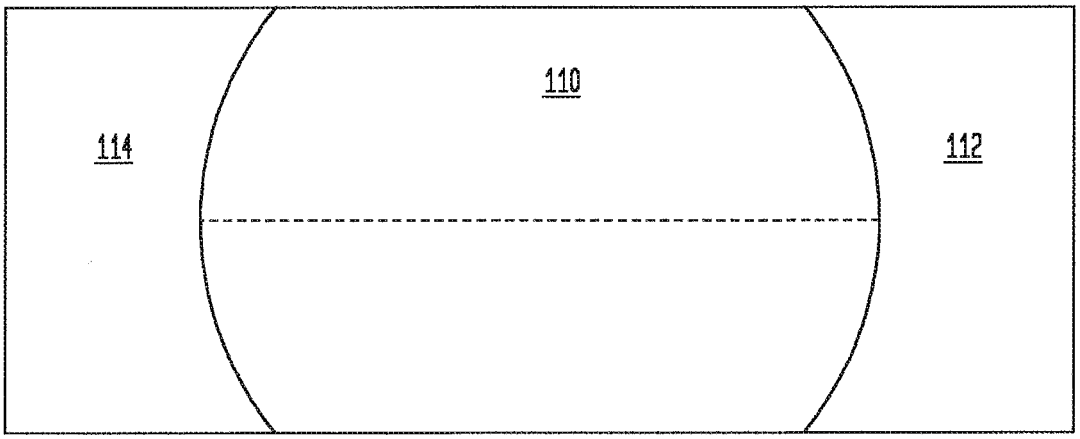
FIG. 3 shows another embodiment of the cold-box apparatus.

Another exemplary embodiment of the cold-box apparatus of the present invention is shown in FIG. 3. Elements illustrated in FIG. 3 which correspond to the elements described above with respect to FIGS. 1 and 2A-2E are designated by corresponding reference numerals increased by 100. Each of the cold-boxes 112, 114 for the tank 110 has its own internal compartment in which is provided ventilation, and gas and fire detection equipment. The embodiment of FIG. 3 is designed for use in the same manner as the embodiments of FIGS. 1 and 2A-2E unless otherwise stated. Referring to FIG. 3, the cold boxes are shown being arranged differently.

Figure 4:
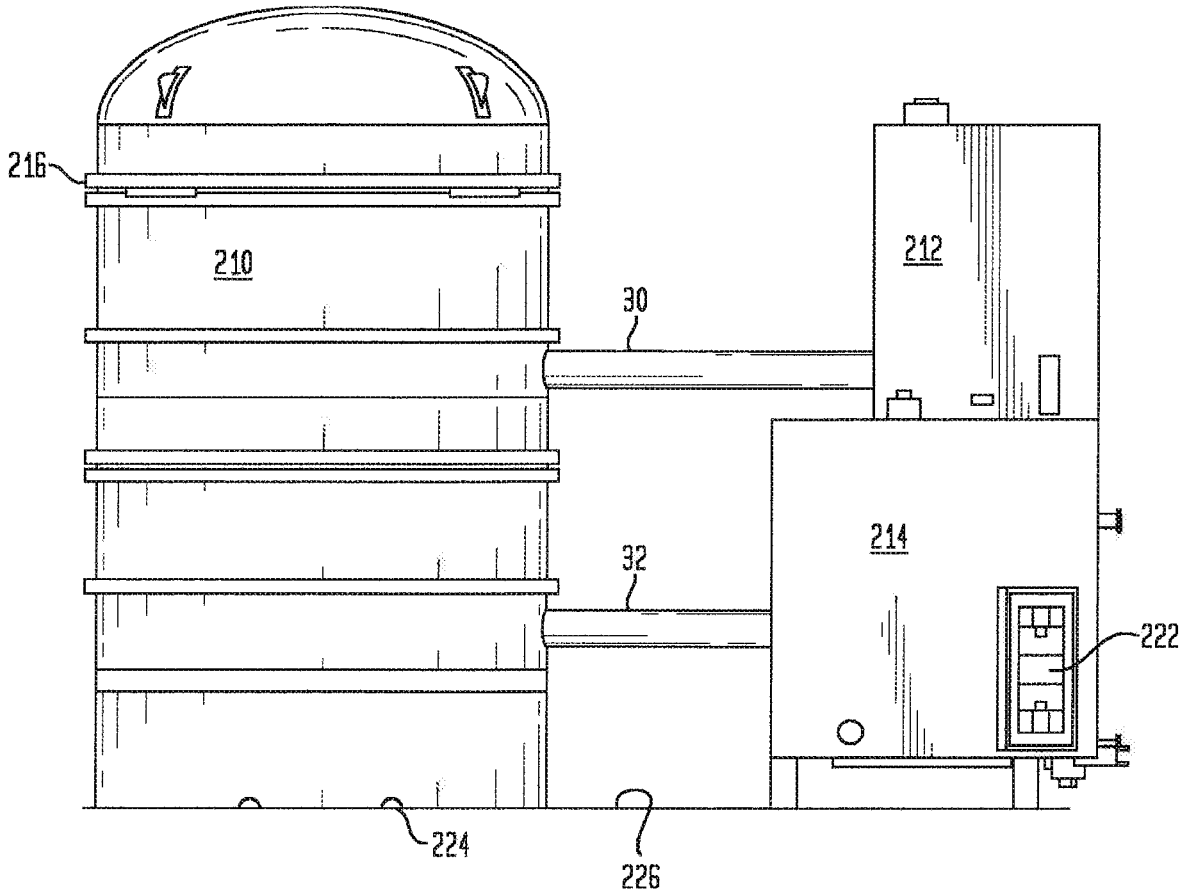
FIG. 4 shows still another embodiment of the cold-box apparatus.

Still another exemplary embodiment of the cold-box apparatus of the present invention is shown in FIG. 4. Elements illustrated in FIG. 4 which correspond to the elements described above with respect to FIGS. 1 and 2A-2E are designated by corresponding numerals increased by 200. As shown in FIG. 4, each one of the cold-boxes 212, 214 is connected to the tank 210 with "naked" piping or piping in a trunk (i.e. double piping). This embodiment provides for the cold-boxes 212, 214 to be disposed at a location remote from the tank 210. Additionally, the cold-boxes 212, 214 could be arranged as a free standing unit, i.e. such as for example a free standing integral unit, located in a separate space or compartment aboard the ship, but spaced apart from the tank 210. Such a space or compartment would have a wall or bulkhead separating the cold-boxes 212, 214 from the tank 210 for added safety and security. The cold-box 212, could be provided with piping 30 interconnecting that cold-box with the tank 210, while the cold-box 214 could be provided with piping 32 interconnecting that cold-box with the tank. As shown in FIG. 4, the piping 30, 32 is elevated off the deck 226 of the ship and is constructed of a material that is corrosive resistant to the effects of salt and brackish water found in marine and inter-coastal environments, and the gaseous cargo of the tank 210. Similar to the embodiments discussed above, the cold-boxes 212, 214 provide control and power requirements for the tank 210. LNG or natural gas (NG) pass through the pipes 30, 32 to respective ones of the cold-boxes 212, 214. Other gases can be stored in the tank 210 (and the tanks 10, 110) for which the cold-boxes 212, 214 are used.

For the regulatory redundancy criteria necessary with respect to the LNG tanks 10, 110, 210 it is essential to have a pair of cold-boxes for each LNG tank, or alternatively a single cold-box with two separate compartments therein, each of the compartments providing the necessary redundancy with respect to the LNG tank. Each cold-box or compartment as the case may be has its own ventilation, and gas and fire detection equipment. In the embodiment shown in FIG. 2B, a single cold-box may be used, wherein a port side (PS) compartment of the cold-box includes one set of power supply for the LNG tank 10, while the starboard side (SB) compartment of the cold-box includes a similar set of power supply equipment for the tank. The SB lower and upper compartments (formerly represented as 12) are connected for ventilation, and gas and fire detection equipment. In addition, the SB upper compartment includes equipment for bunker (fueling) operations, Regulations do not require that bunker equipment need to be redundant. It is also possible to have the upper cold-box as an isolated compartment separate and discreet from the remainder of the cold-box. However, it is not necessary to do so because such an arrangement would require additional ventilation, gas detection, etc.

Although the cold-boxes of the present embodiments have been described with respect to LNG, the present embodiments can be configured for use with any type of gas or gas system, bulk or otherwise.

It will be understood that the embodiments described herein are merely exemplary, and that one skilled in the art may make variations and modifications without departing from the spirit and scope of the invention. All such variations and modifications are intended to be included within the scope of the invention as described and claimed herein. Further, all embodiments disclosed are not necessarily in the alternative, as various embodiments of the invention may be combined to provide the desired result.

What is claimed is:

1. A cold-box system for powering a ship, comprising:

a single bulk gas storage tank mounted on a ship providing fuel for powering the ship;

a plurality of cold-box compartments supported by the ship outside the bulk gas storage tank and operationally connected to the single bulk gas storage tank; and within each cold-box compartment of the plurality of cold-box compartments, control and power supply equipment for the single bulk gas storage tank.

2. The system of claim 1, wherein the plurality of cold-box compartments comprises a pair of compartments.

3. The system of claim 1, wherein a first one of the plurality of compartments is mounted above a second one of said plurality of compartments.

4. The system of claim 1, wherein a first one and a second one of said plurality of compartments are mounted side-by-side.

5. The system of claim 1, wherein a first one of the plurality is mounted to a first side of the bulk gas tank, and a second one of the plurality is mounted to a second side of the bulk gas tank opposite to the first side.

6. The system of claim 1, wherein each one of the plurality of cold-box compartments comprises at least one hatch for access to an interior of each of said compartments.

7. The system of claim 1, wherein the bulk gas tank contains a gas comprising LNG.

8. The system of claim 1, wherein the plurality of cold-box compartments are mounted to the bulk gas tank.

9. The apparatus of claim 1, wherein the bulk gas tank is spaced apart from the plurality of cold-box compartments, and wherein the apparatus further comprises at least one pipe for each one of the plurality of cold-box compartments, the at least one pipe connecting a corresponding one of the cold-box compartments with the bulk gas tank.

10. A method of providing redundancy of the power systems required for each LNG tank aboard a ship, the method comprising:

installing on the ship at least one single bulk gas storage tank mounted on the ship providing fuel for powering the ship, installing, for each of the at least one single bulk gas storage tank, a plurality of cold-box compartments supported by the ship outside the bulk gas storage tank and operationally connected to the at least one single bulk gas storage tank; and within each cold-box compartment of the plurality of cold-box compartments, control and power supply equipment for the at least one single bulk gas storage tank.

11. The system of claim 1, wherein each cold-box compartment of the plurality of cold-box compartments provides redundancy of the control and power supply equipment for the single bulk gas storage tank for each other cold-box compartment of the plurality of cold-box compartments, each cold-box compartment of the plurality of cold-box compartments, control and power supply equipment for the single bulk gas storage tank.

12. The system of claim 1, wherein the plurality of cold-box compartments are separate from each other and having respective internal compartments.

13. The system of claim 1, wherein each cold-box compartment further comprises ventilation, and gas and fire detection equipment.

* * * * *